US007481657B2

(12) United States Patent
Ng et al.

(10) Patent No.: US 7,481,657 B2
(45) Date of Patent: Jan. 27, 2009

(54) ELECTRICAL CONNECTOR

(75) Inventors: Kiat Hup Joey Ng, Singapore (SG); Guat Lian Loo, Singapore (SG); Chen Hong Tan, Singapore (SG)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/659,777

(22) PCT Filed: Jul. 13, 2005

(86) PCT No.: PCT/SG2005/000229

§ 371 (c)(1),
(2), (4) Date: Feb. 7, 2007

(87) PCT Pub. No.: WO2006/022595

PCT Pub. Date: Mar. 2, 2006

(65) Prior Publication Data

US 2008/0081514 A1 Apr. 3, 2008

(30) Foreign Application Priority Data

Aug. 26, 2004 (SG) ..... 200405058-9

(51) Int. Cl.
*H01R 12/00* (2006.01)

(52) U.S. Cl. ..... 439/78; 439/933; 439/637

(58) Field of Classification Search ..... 439/78, 439/933, 637, 636
See application file for complete search history.

(56) References Cited

U.S. PATENT DOCUMENTS

| | | | | |
|---|---|---|---|---|
| 4,090,764 | A | 5/1978 | Malsby et al. | 339/103 M |
| 5,037,332 | A * | 8/1991 | Wilson | 439/608 |
| 6,113,397 | A * | 9/2000 | Myers | 439/63 |
| 2003/0092291 | A1 * | 5/2003 | Lemke et al. | 439/65 |
| 2003/0171010 | A1 * | 9/2003 | Winings et al. | 439/55 |
| 2007/0184718 | A1 * | 8/2007 | Akama et al. | 439/608 |

FOREIGN PATENT DOCUMENTS

| | | |
|---|---|---|
| EP | 0 330 009 A2 | 8/1989 |
| EP | 0 362 841 B1 | 5/1994 |
| EP | 0 422 785 B1 | 3/1995 |
| WO | WO 01/59883 A1 | 8/2001 |

* cited by examiner

*Primary Examiner*—Gary F. Paumen
(74) *Attorney, Agent, or Firm*—Harrington & Smith, PC

(57) ABSTRACT

An electrical connector including dielectric housing; and a plurality of arrays of terminals disposed in respective portions of the dielectric housing, wherein at least two of the arrays of terminals have different pitches; and wherein at least one of the respective portions of the housing is partially removed such that a value of the dielectric constant between terminals of the array of terminals in said portion of the dielectric housing is controlled.

11 Claims, 3 Drawing Sheets

ELECTRICAL CONNECTOR

FIELD OF THE INVENTION

The present invention relates broadly to the field of connectors, such as connectors used in printed circuit boards (PCB) and to a method of controlling electrical characteristics of an electrical connector.

BACKGROUND

Electrical Connectors are often used in electronic devices to connect a PCB to another PCB or external devices. A PCB connector usually comprises a receiving member or a receptacle that is mounted to the PCB and a plug member. Each of the receptacle and plug members comprise arrays of electrical terminals. The housing of the receptacle and plug members are designed to cooperably mate with each other such that in an engaged position electrical connections are established between the respective electrical terminals of the receptacle and plug member.

A typical connector comprises a dielectric housing containing an assembly of a plurality of electrical terminals of dimensions and pitch which are designed according to the specific usage. Often, electrical terminals are grouped in a plurality of arrays. Each array usually has a plurality of electrical terminals of the same pitch.

FIG. 1 illustrates a perspective view of an existing SAS (serially attached SCSI) receptacle 10. The elongate receptacle 10 comprises a dielectric housing which is moulded to accommodate the electrical terminals 7. The receptacle 10 has three sets of arrays, 1, 2, and 3, of terminals 7 arranged on different planes of the receptacle. The terminals 7 are housed in respective chambers 5.

When designing a connector as shown in FIG. 1, factors such as signal integrity are of concern especially for fine pitched (e.g. 0.8 mm pitch) terminals. Parameters, such as cross-talk, are a problem especially in high frequency data transfer application. In particular, cross-talk is significant between fine-pitched terminals.

SUMMARY

In accordance with a first aspect of the present invention there is provided an electrical connector comprising a dielectric housing; and a plurality of arrays of terminals disposed in respective portions of the dielectric housing, wherein at least two of the arrays of terminals have different respective pitches; and wherein at least one of the respective portions of the dielectric housing is partially removed such that a value of the dielectric constant between terminals of the array of terminals in said portion of the dielectric housing is controlled.

The portion of the dielectric housing in which the array having a smaller pitch is disposed may be partially removed.

The arrays of terminals may comprise one or more power terminal arrays and one or more signal terminal arrays.

At least the portion of the dielectric housing in which one signal terminal array may be disposed is partially removed.

At least one of the respective portions of the dielectric housing may be partially removed such that the terminals are partially exposed.

The at least one of the respective portions of the dielectric housing may be partially removed such that an opening is formed in a wall of the dielectric housing in said portion, and the terminals extend across the opening.

The at least one of the respective portions of the dielectric housing which is partially removed may comprise a protruded housing section of the dielectric housing.

The connector may comprise a Serial Attached SCSI Receptacle.

The terminals may comprise one or more of a group comprising through-hole, surface mount, press fit, and compression fit terminals.

The value of the dielectric constant between terminals of the array of terminals in said portion of the dielectric housing may be reduced.

In accordance with a second aspect of the present invention there is provided a method of controlling electrical characteristics of an electrical connector having a plurality of arrays of terminals disposed in respective portions of a dielectric housing, wherein at least two of the arrays of terminals have different respective pitches, the method comprising partially removing at least one of the respective portions of the dielectric housing of the connector such that a value of the dielectric constant between terminals of the array of terminals in said portion of the dielectric housing is controlled.

BRIEF DESCRIPTION OF THE DRAWINGS

Non-limiting embodiments of the invention are described hereinafter with reference to the drawings, in which.

DETAILED DESCRIPTION

Figure 1:
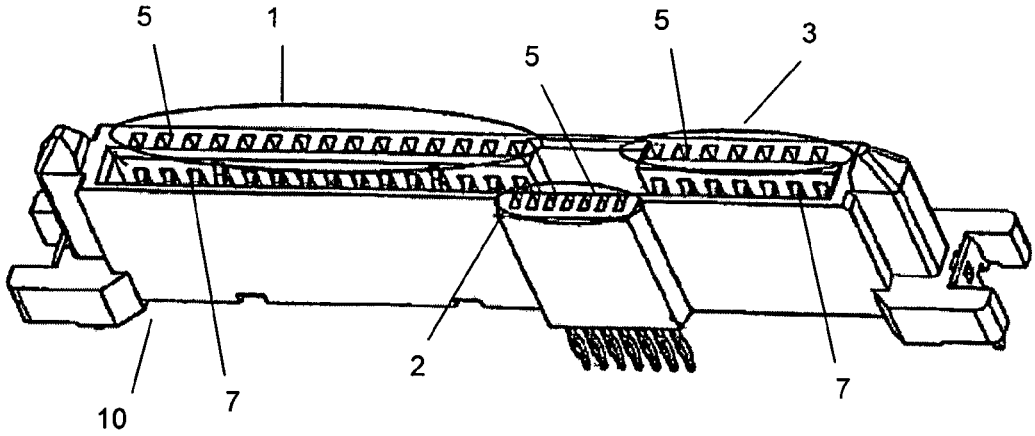
Figure 1 (Prior Art)
FIG. 1 is a perspective view of a conventional SAS (serial attached SCSI) receptacle.
Figure 2:
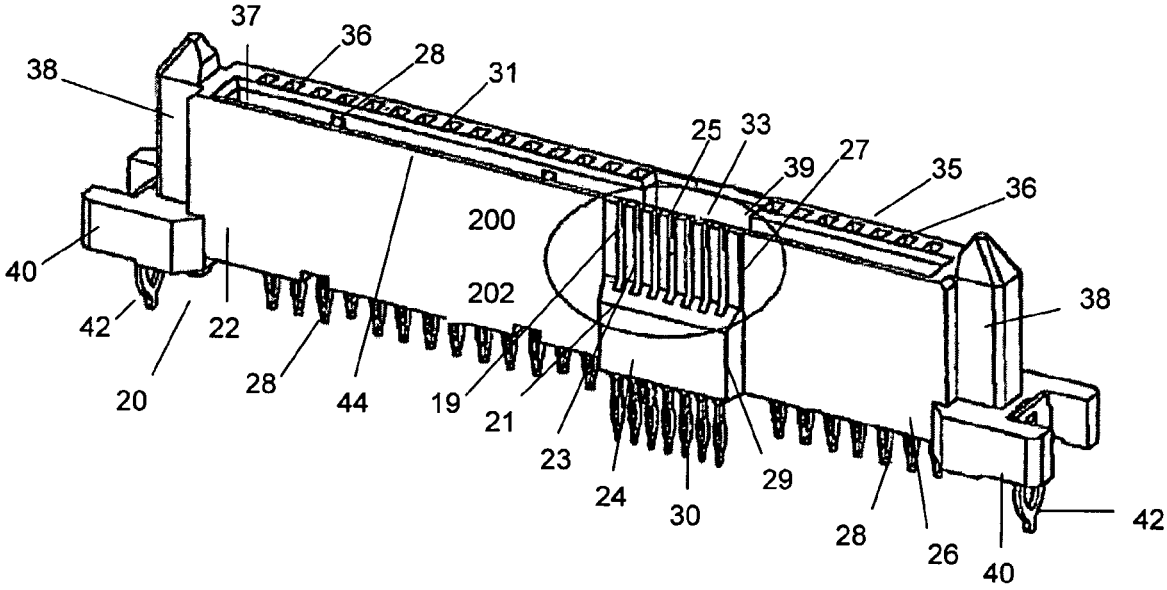
FIG. 2 is a perspective view of an SAS (serial attached SCSI) receptacle according to an example embodiment of the present invention.

FIG. 2 illustrates a perspective view of a SAS (serially attached SCSI) receptacle 20 according to an example embodiment. The elongate receptacle 20 comprises a dielectric housing which is moulded to accommodate electrical terminals 28, 30. The receptacle 20 has three sets of arrays, e.g. 33, arranged on different planes of the receptacle 20. A first array 31 consists of twenty-two terminals 28 of 1.27 mm pitch and is located towards one end 22 of the receptacle 20, along one edge thereof, each terminal 28 being positioned in their respective chambers 36. The terminals 28 of the first array 31 usually connect power lines. A second array 33 consists of eight terminals 30 of 0.8 mm pitch. The second array 33 is located towards the center 24 of the receptacle 20 and on the edge thereof which is opposite to the edge having the first array 31. Each terminal 30 is positioned in respective slots 19. The terminals 30 of the second array 33 usually connect signal lines. A third array 35 consists of seven terminals 28 of 1.27 mm pitch and is located on the other end 26 of the receptacle 20 and on the same edge thereof as that of the first array 31, each terminal being positioned in their respective chambers 36. The terminals 28 of the third array 35 usually connect signal lines.

The first 31 and the third 35 arrays are located on the same edge of the receptacle 20 and are flush with the outer surface of the receptacle 20, whilst the centre portion 24, housing the second array 33, protrudes out of the wall 22 of the receptacle 20.

Each of the ends 20, 26 of the receptacle 20 are terminated with a vertically positioned pillar 38 and a horizontally positioned base 40. On one edge of each of the base 40, a metallic terminal 42 is formed in a vertical direction to enable the receptacle to be inserted on to a PCB thereby providing rigidity to the receptacle 20. The tail portions of the electrical terminals 28, 30 protrude the receptacle 20 and are of the press-fit type i.e. the tail portions of these terminals are resilient in a lateral direction to provide support to the receptacle connector and the PCB when the receptacle connector is inserted in to a PCB during assembly.

The center portion 24 comprises the array 33 of electrical terminals 30 that are seated in slots 19. Since the center portion 24 is used for electrically connecting signal lines, the pitch of the terminals 30 are usually lower than the pitch of those electrical terminals 28 that carry other lines e.g. power lines. The design of the low pitched electrical terminals 30 should be aimed at improving signal integrity and parameters, such as reduction of cross-talk. One way of achieving such an object is to reduce the dielectric constant of the dielectric material of the housing. Reducing or removing the dielectric material at the center portion 24 reduces the value of dielectric constant between the terminals 30. This results in reduced capacitance, which is very important in high frequency applications.

The reduction in dielectric material is achieved in the example embodiment by partially removing or reducing the dielectric material of the protruded center portion 24. The protruded center portion 24 has upper and lower portions 200, 2020 respectively. The width 29 of the protrusion of the lower portion 202 is greater that of the width 27 of the upper portion 200.

The upper and lower portions 200, 202 are connected by an intersecting portion 21, which is shown to be inclined in the example embodiment. The intersecting portion 21 may also be perpendicular to the edge of the receptacle 20. The construction of the upper portion is a set of recesses 23. The electrical terminals 30 are seated in the recesses 23.

The body of the electrical terminals 30 is seen partially embedded inside the slots 21 in the lower portion 202 of the centre portion 24 of the receptacle 20. The tail of each of the electrical terminals 30 protrudes the receptacle 20, to enable electrical connection with a PCB. The tail portions of the electrical terminals 30 are of the press-fit type. i.e. these terminals are resilient in a lateral direction to provide support to the receptacle connector and the PCB when the receptacle connector is inserted into a PCB during assembly.

Figure 4B:
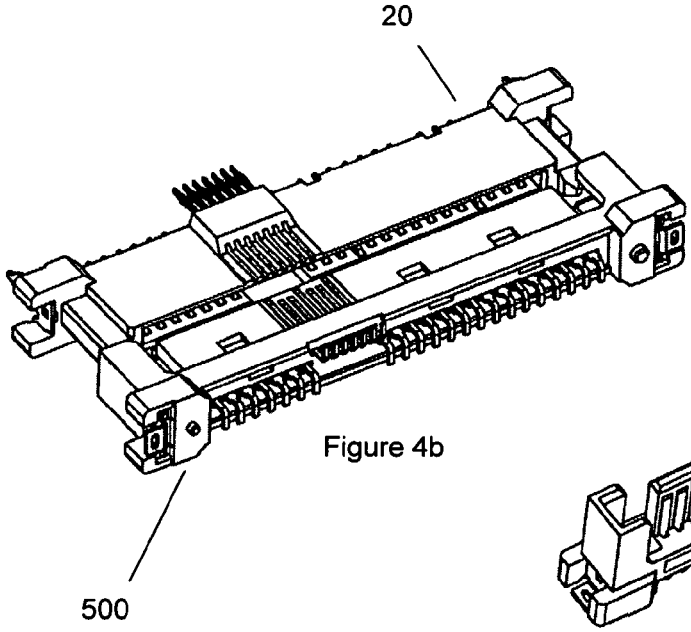
FIG. 4*b* is a perspective view of an assembly of the plug of FIG. 4*a* and the SAS (serial attached SCSI) receptacle of FIG. 2.
Figure 4A:
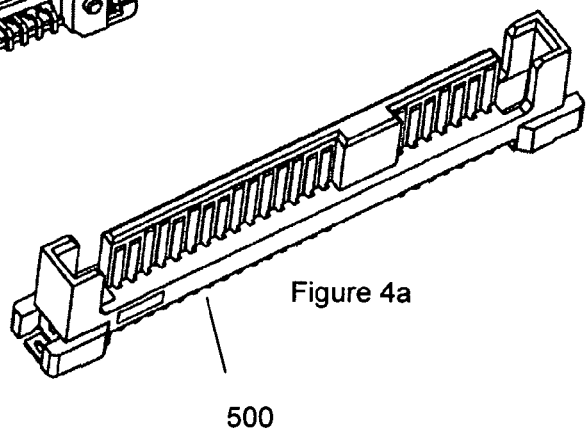
FIG. 4*a* is a perspective view of a plug in accordance with an example embodiment suitable for use with the SAS receptacle of FIG. 2.

The receptacle 20 is designed to receive a plug 500, as shown in FIGS. 4*a* and 4*b*, of a cable or another PCB, and as the plug co-operably mates with the receptacle 20, electrical connections between the respective terminals 28, 30 of the receptacle 20 and the plug are established.

Figure 3A:
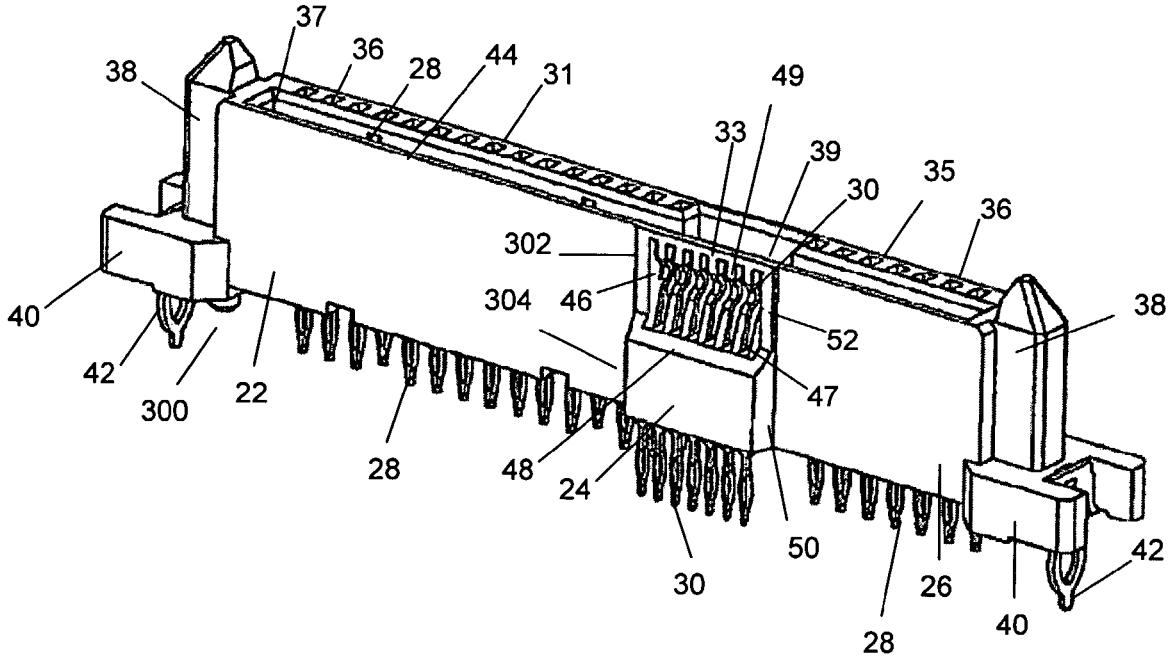
FIG. 3*a* is a perspective view of an SAS (serial attached SCSI) receptacle according to an example embodiment of the present invention.

FIG. 3*a* illustrates a perspective view of a SAS (serially attached SCSI) receptacle 30 according to the second embodiment. When compared to the first embodiment, the construction of the receptacle differs in the construction of the centre portion 24.

As in the second embodiment, the center portion 24 comprises an array 33 of electrical terminals 30 that are received in slots 49. The protruded center portion 24 has upper and lower portions 302, 304 respectively. The width 50 of the lower portion 304 is greater than the width 52 of the upper portion 302. The upper and lower portions 302, 304 are connected by an intersecting portion 48, which is shown to be inclined in the example embodiment. The intersecting portion 48 may also be perpendicular to the edge of the receptacle 300.

Unlike the second embodiment, the part of the upper portion 302 lacks entirely the dielectric material resulting in an opening 46 in wall 22. The slots 47 are present in the bottom portion 304 for receiving the terminals 30, which extend across the opening formed in wall 22. The heads of the electrical terminals 30 are positioned in their respective slots 49. The tails of the electrical terminals 30 protrude the receptacle 300 to enable physical contact with a PCB.

Figure 3B:
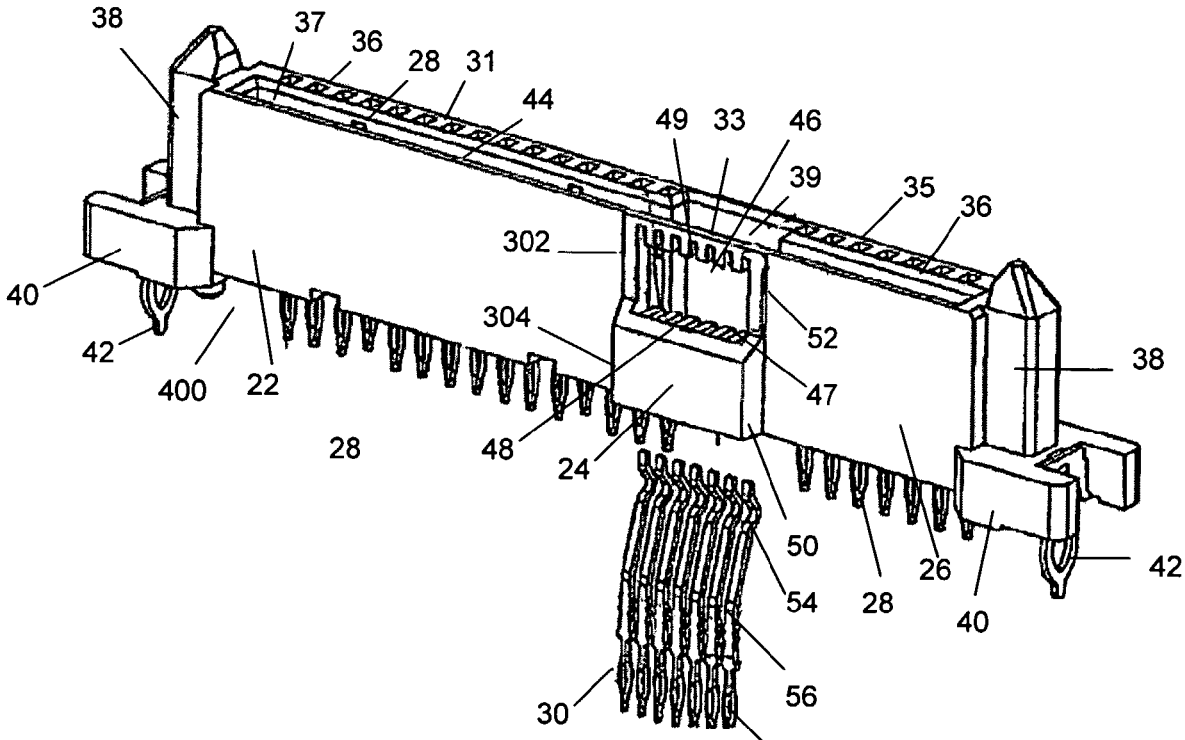
FIG. 3*b* is an exemplified view of FIG. 3*a* with electrical terminals dis-assembled.

FIG. 3*b* is a view of FIG. 3*a* with electrical terminals of 30 of the array 33 dis-assembled, fully exposing the opening 46 in wall 22. Slots 49 can be seen on the top surface of the upper portion. Further, slots 47 are also present on the bottom surface of the upper portion.

Each electrical terminal 30 has a head 54, a body 56 and a tail 58. The head 54 has a compression tip to enable physical connection with electrical terminals of a plug. The body 56 is elongate and is bent at appropriate positions for achieving resiliency. The tail portion 58 is press-fit type having resilience in the lateral direction of the terminal. This is to effectively insert a receptacle onto a PCB during assembly.

The number of arrays and shown above can be less or more than three. The position and designation of the arrays for carrying signal and power lines can be altered. The number and pitch of electrical terminals of the arrays can be varied with a corresponding variation in the length of the receptacle.

The dimensions of the arrays can be varied. The dimension and pattern of the removal of dielectric material may be altered.

The tail portions of the electrical terminals 28, 38 are shown to be press-fit. Other types, such as compression, through hole, surface mount etc. may also be employed It will be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

The invention claimed is:

1. An electrical connector comprising a dielectric housing; and a plurality of arrays of terminals disposed in respective portions of the dielectric housing, wherein at least two of the arrays of terminals have different respective pitches;

wherein at least one of the respective portions of the dielectric housing is partially removed such that a value of the dielectric constant between terminals of the array of terminals in said portion of the dielectric housing is controlled, wherein the terminals disposed in said portion of the dielectric housing are partially exposed; and wherein an opening is formed completely through a wall of the dielectric housing in said portion, and the terminals in said portion extend across the opening from a bottom of the opening to a top of the opening.

2. The connector as claimed in claim 1, wherein the portion of the dielectric housing in which the array having a smaller pitch is disposed is partially removed.

3. The connector as claimed in claim 1, wherein the arrays of terminals comprise one or more power terminal arrays and one or more signal terminal arrays.

4. The connector as claimed in claim 3, wherein at least the portion of the dielectric housing in which one signal terminal array is disposed is partially removed.

5. The connector as claimed in claim 1, wherein the at least one of the respective portions of the dielectric housing which is partially removed comprises a protruded housing section of the dielectric housing.

6. The connector as claimed in claim 1, wherein the connector comprises a Serial Attached SCSI Receptacle.

7. The connector as claimed in claim 1, wherein the terminals comprise one or more of a group comprising through-hole, surface mount, press fit, and compression fit terminals.

8. The connector as claimed in claim 1, wherein the value of the dielectric constant between terminals of the array of terminals in said portion of the dielectric housing is reduced.

9. An electrical connector comprising:

a dielectric housing; and a plurality of arrays of terminals disposed in respective portions of the dielectric housing, wherein at least two of the arrays of terminals have different respective pitches;

wherein at least one of the respective portions of the dielectric housing is partially removed such that a value of the dielectric constant between terminals of the array of terminals in said portion of the dielectric housing is controlled; and wherein the at least one of the respective portions of the dielectric housing which is partially removed comprises a protruded housing section of the dielectric housing.

10. An electrical connector comprising a dielectric housing having a plug receiving slot between opposite walls of the dielectric housing;

a first array of terminals disposed in a first portion of the dielectric housing; and a second array of terminals disposed in a second portion of the dielectric housing, wherein the terminals in the first array have a different pitch relative to the terminals in the second array, wherein the dielectric housing comprises at least one slot extending completely through a first one of the walls of the dielectric housing at the second portion between the plug receiving slot and an exterior of the first wall, wherein the terminals in second array extend across the at least one slot, and wherein the terminals in second array are exposed at opposite sides of the first wall at the at least one slot.

11. An electrical connector as in claim 10 wherein the at least one slot comprises an opening completely through the first wall of the dielectric housing at the second portion, wherein the terminals in second array extend across the opening, wherein the opening provides an air gap directly between the terminals of the second array at the opening, and wherein the terminals are exposed at opposite sides at the first wall at the opening.

* * * * *